US007564331B2

(12) United States Patent
Hashimoto

(10) Patent No.: US 7,564,331 B2
(45) Date of Patent: Jul. 21, 2009

(54) CLAMPING TOOL FOR CHAIN ENDS OF ACCESSORIES

(75) Inventor: Hisajiro Hashimoto, Toyota (JP)

(73) Assignee: Yugen Kaisha Houseki-No-Angel, Nagoya-Shi, Aichi-Ken (JP)

( * ) Notice: Subject to any disclaimer, the term of this patent is extended or adjusted under 35 U.S.C. 154(b) by 301 days.

(21) Appl. No.: 10/594,540

(22) PCT Filed: Jun. 30, 2005

(86) PCT No.: PCT/JP2005/012535

§ 371 (c)(1),
(2), (4) Date: Sep. 27, 2006

(87) PCT Pub. No.: WO2006/006476

PCT Pub. Date: Jan. 19, 2006

(65) Prior Publication Data

US 2007/0180856 A1 Aug. 9, 2007

(30) Foreign Application Priority Data

Jul. 14, 2004 (JP) ..... 2004-206769

(51) Int. Cl.
*H01H 9/00* (2006.01)
*A44B 21/00* (2006.01)

(52) U.S. Cl. ..... 335/207; 24/303

(58) Field of Classification Search ..... 335/205–207, 335/302–306, 285; 24/303
See application file for complete search history.

(56) References Cited

U.S. PATENT DOCUMENTS

| | | | | |
|---|---|---|---|---|
| 5,050,276 | A | 9/1991 | Pemberton | |
| 5,197,168 | A | 3/1993 | Levy | |
| 5,349,725 | A * | 9/1994 | Levy | 24/303 |
| 5,435,047 | A | 7/1995 | Colpo | |
| 5,664,298 | A * | 9/1997 | Nessar-Ivanovic | 24/303 |
| 6,508,080 | B1 | 1/2003 | Ninomiya | |
| 6,981,391 | B2 * | 1/2006 | Suzuki | 63/3.1 |
| 7,073,232 | B1 * | 7/2006 | Fuhrman et al. | 24/303 |
| 7,207,091 | B2 * | 4/2007 | Dunaye | 24/303 |

FOREIGN PATENT DOCUMENTS

| | | |
|---|---|---|
| DE | 44 23 388 | 8/1995 |
| JP | 8-126506 | 5/1996 |
| JP | 9-289911 | 11/1997 |
| JP | 10-262715 | 10/1998 |

* cited by examiner

*Primary Examiner*—Lincoln Donovan
*Assistant Examiner*—Bernard Rojas
(74) *Attorney, Agent, or Firm*—Jordan and Hamburg LLP

(57) ABSTRACT

A clamping tool of chain ends of an accessory in which a holder provided at one end of a chain portion of the accessory is engaged with a holder receiver provided at the other end of the chain portion to be interlocked with each other, wherein the holder and the holder receiver are respectively provided as attracting members with magnets attracting each other or with a magnet and a metal material attracted by the magnet at positions capable of guiding the holder and the holder receiver to a proper engaging location. In accordance with the invention, a pair of interlocking members can be guided to and located at proper interlocking positions with respect to each other without depending on visual observation.

11 Claims, 6 Drawing Sheets

CLAMPING TOOL FOR CHAIN ENDS OF ACCESSORIES

BACKGROUND OF THE INVENTION

1. Field of the Invention

The present invention relates to a clamping tool for chain ends of accessories. More particularly, the invention relates to a clamping tool for clamping ends of a chain portion of accessories, which are formed from a chain or has a chain-shaped part, such as a necklace, a bracelet, an anklet and the like, for example.

2. Description of the Related Art

Conventionally, proposed have been clamping tools, one of which uses a spring and is referred to as a pulling ring type and the other of which uses a planer spring and is referred to as an insert type, and the like.

[Literature 1] JP-A-08-126506

Literature 1, for example, discloses an example of the pulling ring type clamping tool. In Literature 1, disclosed is a clamping tool for a necklace or the like in which a fixed disk provided with a clamping ring having a penetrating hole and an inserting hole having a notched part is fitted with a rotary disk provided with an inserting hole having a notched part.

[Literature 2] JP-A-09-289911

In Literature 2, disclosed is a clamping tool for a necklace or the like comprising a male member provided with a projection whose tip is expanded and a female member provided with a channel part capable of fitting the projection in. One end of the channel part is opened to the outer periphery of the female member and a spring wire is formed on an inner side of the channel part so that the projection of the male member can be snap-fitted to the channel part.

The clamping tool disclosed in Literature 1, however, applies a way of interlocking a pair of interlocking members by visual observation. The interlocking members are actually so small that the pair of interlocking members cannot be easily located in proper positions with respect to each other to be interlocked. Further, in the case of accessories such as a necklace in which a clamping tool is interlocked behind a neck of a person putting the accessory on, an interlocking operation cannot be visually observed, so that it is especially difficult to carry out the interlocking operation. Moreover, it is also difficult to confirm whether the interlocking members are properly interlocked or not.

On the other hand, an object of the clamping tool disclosed in Literature 2 is to simplify interlock of the clamping tool. As can be seen from description of "perform attachment and detachment (of the male member to the female member) by feeling without looking" in Literature 2, however, the male member and the female member should be located at proper interlocking positions with respect to each other by groping. This means that the operation in Literature 2 is substantially almost same as that of the related art disclosed in Literature 1 in difficulty of the operation and confirmation whether the interlocking members are properly interlocked or not.

In accordance with the reasons mentioned above, the clamping tools disclosed in Literatures 1 and 2 are troublesome in properly interlocking, and in addition, are difficult in confirmation whether the interlocking members are properly interlocked or not. Moreover, as a result of the difficulty, there have been many cases that a necklace or the like is put on without properly interlocking the interlocking members and this causes unconscious loss of the necklace.

SUMMARY OF THE INVENTION

An object of the invention is to arrange, in an accessory having a chain or a chain-shaped part, a pair of interlocking members forming a clamping tool of ends of the chain portion so as to be located at proper positions with respect to each other without depending on visual observation or groping. Another object of the invention is to enable location of the pair of interlocking members at the proper interlocking positions to be confirmed by a signal sound.

A first aspect of the invention is a clamping tool of chain ends of an accessory in which a holder provided at one end of a chain portion of the accessory is engaged with a holder receiver provided at the other end of the chain portion to be interlocked with each other, wherein the holder and the holder receiver are respectively provided as attracting members with magnets attracting each other or with a magnet and a metal material attracted by the magnet at positions capable of guiding the holder and the holder receiver to a proper engaging location.

In the clamping tool of chain ends of an accessory in accordance with the first aspect of the invention, only locating the holder and the holder receiver, which form the clamping tool, so as to be roughly close to each other enables the holder and the holder receiver to be located at proper engagement positions owing to a guiding operation of the attracting members. The attracting members make a click sound of connection when they are attracted by each other in addition to the guiding operation. Accordingly, the sound of connection can be used as a signal sound to confirm that the holder and the holder receiver are located at proper interlocking positions.

As a result, visual observation is not necessary in locating the holder and the holder receiver, which are small members, at the proper engagement positions for interlock. This allows the clamping tool of an accessory to be simply, easily, and further, certainly interlocked, even in the case of an accessory such as a necklace whose clamping tool is interlocked behind a neck of a person putting the accessory on, for example.

In comparison between the clamping tool in accordance with the first aspect and the interlocking tool in Literature 2 in the case that the accessory is a necklace, the latter is required to "locate" a male member and a female member "at proper interlocking positions by groping" while the former is enough to "roughly closely locate" the holder and the holder receiver "by groping". In addition, in the former case, a signal sound indicating that "the interlock is completed" is outputted. Thus, there is a big difference in convenience in use between the above tools.

In a second aspect of the invention, the holder according to the first aspect is a spring-close type alligator clip in which a pair of jaw members is rotatably held so as to be able to be opened and closed and the holder receiver is an interlocking member fitted in between the pair of opening jaw members to be interlocked.

With the alligator clip type holder in accordance with the second aspect, it is generally easy to operate the clamping tool. Even when an accessory such as a necklace has a clamping tool, which should be interlocked behind a neck of a person putting the accessory on, for example, operations of interlocking the clamping tool and releasing interlock of the clamping tool can be further simply and certainly performed because of the alligator clip type of holder in addition to an effect of the first aspect.

In a third aspect of the invention, one attracting member is provided in the alligator clip according to the second aspect and the other attracting member is provided at a tip of the interlocking member.

In the case of the alligator clip type holder in accordance with the second aspect, the alligator clip is opened so that the interlocking member, which is the holder receiver, would be fitted in the opening to be interlocked. Accordingly, providing one attracting member in the alligator clip and the other attracting member at a tip of the interlocking member allows the guiding operation of the attracting members and the interlocking operation of the holder to be closely integrated, so that convenience in use is especially improved.

In a fourth aspect of the invention, an attracting member provided in the alligator clip according to the third aspect is fixed to any one of the pair of jaw members or a holding member for holding the attracting member is held on a holding shaft for rotatably holding the pair of jaw members.

A way of fixing or stably holding one attracting member provided in the alligator clip at a proper location so as to be attracted by the other attracting member provided at a tip of the interlocking member is not limited. As described in the fourth aspect, for example, however, preferably exemplified can be a mode in which the attracting member is fixed to any one of the jaw members or a holding member for holding the attracting member is held on a holding shaft for rotatably holding the pair of jaw members.

In a fifth aspect of the invention, an attracting member provided in the alligator clip accordingly to the third aspect or a holding member for holding the attracting member is connected to the pair of jaw members by means of a linking arm to form a link mechanism in which the attracting member operates to project from an opening in opening the pair of jaw members.

The alligator clip in accordance with the third aspect has a mechanism for opening/closing the pair of jaw members in a spring-close way and further has a structure in which an attracting member is provided in the alligator clip (between the pair of jaw members). Accordingly, arranging a link mechanism so that the attracting member would be operated to project from the opening in opening the pair of jaw members enables attraction between the projecting attracting member and the attracting member on the interlocking member side to be further easily performed. This allows the guiding operation of the attracting members in the interlocking operation to be especially effectively achieved.

In a sixth aspect of the invention, the linking arm of the link mechanism according to the fifth aspect is a spring for closing the alligator clip.

In the case that the link mechanism in accordance with the fifth aspect is provided in the alligator clip, the alligator clip per se is originally arranged to be of a spring-close type. This allows the linking arm of the link mechanism to be also used as a spring for closing the alligator clip. It is of course possible, however, to separately provide the linking arm of the link mechanism and the spring for closing the alligator clip.

In consideration of design, each of the case of using the linking arm of the link mechanism as a spring for closing the alligator clip as in the sixth aspect and the case of separately providing the linking arm of the link mechanism and the spring for closing the alligator has its advantages and disadvantages in operation and effect.

The above and other advantages of the invention will become more apparent in the following description and the accompanying drawings.

DETAILED DESCRIPTION OF THE INVENTION

Figure 1:
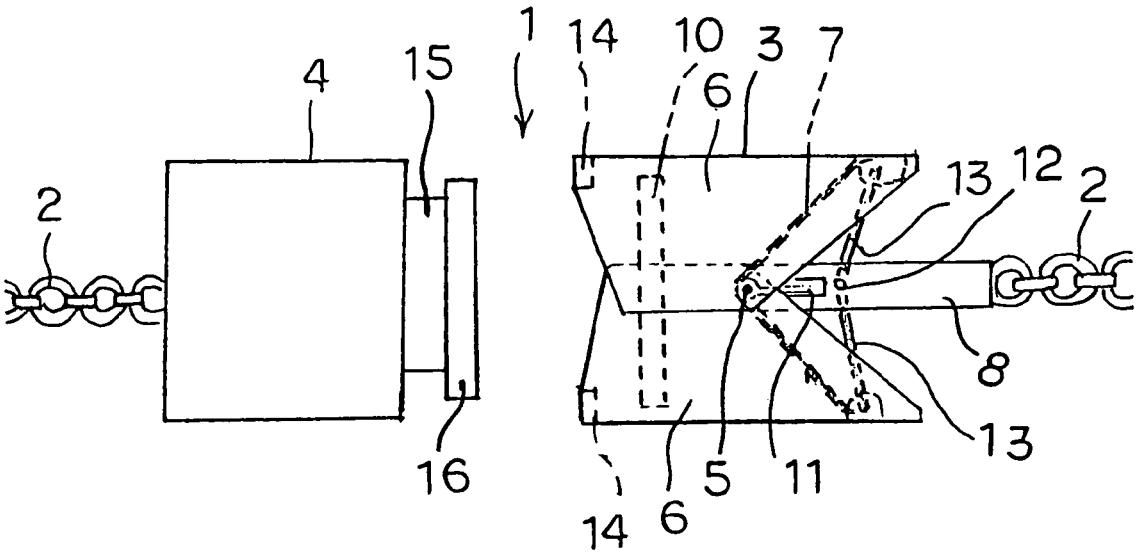
FIG. 1 is a front view of a clamping tool, which is in a state of separation, in accordance with Embodiment 1.

Now, described will be embodiments in accordance with the first to sixth aspects of the invention including the best modes for carrying out the invention.

[Clamping Tool for Chain Ends of Accessories]

A clamping tool for chain ends of accessories in accordance with the invention comprises a holder provided at one end of a chain portion of an accessory and a holder receiver provided at the other end of the chain portion. The holder and the holder receiver can be engaged with each other for interlock.

"Accessory" in the above context is not limited so long as it is an accessory in the shape of a chain or an accessory having a chain-shaped portion, and is preferably exemplified by a necklace, a bracelet, an anklet or the like, for example.

Further, "a chain" in the invention means a long and narrow member capable of freely bending as a whole and is not limited to a usual member in the shape of a chain. That is to say, "a chain" in the invention includes, other than a usual member in the shape of a chain, a member formed from a solid material into a long and narrow member capable of freely bending in the shape other than a chain, a member in the shape of a string, a belt or yarn, which is formed from a fiber material and such, a member formed from a comparatively few stick-shaped bodies unfixedly connected and such. Moreover, a material for forming the member includes a various kind of silicic materials including precious stone, other inorganic materials, vegetable materials, plastic materials and the like other than metal without any limitation.

[Holder and Holder Receiver]

Kinds and structures of the holder and the holder receiver are not limited as long as the holder and the holder receiver apply a mechanism such that arbitrarily-shaped portions are engaged to achieve interlock of a clamping tool and release of the engagement allows the interlock of the clamping tool to be released. The holder and the holder receiver in predetermined proper engagement positions (or in an engaged state) are capable of certain interlock of the clamping tool. The holder and the holder receiver are provided with the respective attracting members mentioned later. The clamping tools in accordance with various kinds of conventional art such as those in the above description can be also the holder and the holder receiver subject to the invention when they are equivalent to the holder and the holder receiver in the above context.

In the clamping tool for chain ends of accessories in accordance with the invention, exemplified is especially preferable holder and holder receiver in which the holder is a spring-close type alligator clip for rotatably holding a pair of jaw members so that the pair of jaw members can be opened and closed while the holder receiver is an interlocking member fitted in between the pair of opening jaw members to be interlocked.

[Alligator Clip and Interlocking Member]

A spring-close type alligator clip or an interlocking member means the one having at lease a following structure.

That is to say, there can be two kinds of spring-close type alligator clips considered: one is a nonintersecting type in which a pair of jaw members is rotatably held basically in parallel (a basic structure like a usual clothespin); and one is an intersecting type in which a pair of jaw members is rotatably held so as to intersect (a basic structure like a scissors, for example). Both of the above are included in the alligator clip in accordance with the invention.

The spring-close type alligator clip comprises a pair of jaw members for gripping an interlocking part of an interlocking member. The pair of jaw members is rotatably held on a holding shaft (one same holding shaft, usually) so that tips of the jaw members (gripping parts for the interlocking member) would be urged to move from location in an opening state to location in a closed state by means of a spring means provided between the jaw members.

When the tips of the pair of jaw members are in the closed state, namely, in a condition that the alligator clip is in the closed state, an operation of closing rear ends of the pair of jaw members against urging force of the spring means basically allows the alligator clip to be in an opening state in the case of the above-mentioned nonintersecting alligator clip. On the other hand, in the case of the intersecting alligator clip, an operation of opening a rear end of the pair of jaw members against urging force of the spring means allows the alligator clip to be in an opening state.

In the case of the spring-close type nonintersecting alligator clip, gripping a handle portion of the jaw members by means of a hand and fingers to rotate the same in a closing direction allows the alligator clip to be in the opening state. Releasing the handle portion gripped by a hand and fingers after locating the alligator clip at a position engaging with the interlocking member in the opening state allows the alligator clip to be engaged with the interlocking member by the urging force of the spring means, so that the clamping tool is clamped.

The interlocking member is not limited so long as it is in a proper shape capable of insertion between the jaw members of the opening alligator clip and it is provided with an engaging portion in the shape capable of certain engagement with the jaw members of the alligator clip. The tips of the jaw members can be formed into a fixed proper engagement shape for the purpose of achieving certainty in engagement. The interlocking member should include an attracting member corresponding to the attracting member on an alligator clip side as mentioned later. Accordingly, a variety of design can be considered in relation to the engaging-shaped portions of the interlocking member and setting of the attracting member.

[Attracting Member and Holding Member]

An attracting member is provided to each of the holder provided at one end of a chain of an accessory (the above-mentioned alligator clip, for example) and the holder receiver provided on the other end of the chain (the interlocking member, for example). The attracting members may be formed from a combination between an N-pole magnet and an S-pole magnet, which are attracted by each other, or may be formed from a combination between a magnet and a fixed metal material (an iron material, for example) attracted by the magnet.

As positions for providing the attracting members of the holder and the holder receiver, selected are proper positions capable of guiding the holder and the holder receiver to a proper engaging location. Such a location is difficult to be uniformly regulated since it varies in accordance with shapes or forms of engagement of the holder and the holder receiver.

In the case that the clipping tool for chain ends of accessories is formed from the alligator clip and the interlocking member, it is preferable in view of the reason described in relation to the third aspect to provide one attracting member inside the alligator clip and the other attracting member at the tip of the interlocking member.

In the above case, the location of the attracting member provided inside the alligator clip is not limited. For example, the attracting member may be provided in an inner part of one or both of the pair of jaw members. Embodiment 4 mentioned later exemplifies a case of fixing the attracting member to an inner part of one of the jaw members of the alligator clip. In this case, it is not necessary to provide a holding member mentioned below, so that a structure of the alligator clip can be simplified. Further, it may be possible to provide a proper holding member located between the pair of jaw members to be used as the attracting member. More preferably, the attracting member may be provided at the end of the holding member on a front end side of the alligator clip, as shown in common in Embodiments 1 to 3 described later. The jaw members can directly hold such a holding member. The holding shaft rotatably holding the pair of jaw members often passes through the holding member in the case that the holding member is provided. Accordingly, the holding member can be rotatably held by means of the holding shaft.

In the clipping tool for chain ends of accessories in accordance with the invention, the holder such as an alligator clip, for example, is provided on one end of a chain of an accessory as described above. More concretely, an end of a chain can be connected to an arbitrary portion of an arbitrary member on the holder side. For example, an end of a chain of an accessory can be connected to one or both of the jaw members (more preferably, the rear end thereof) of the alligator clip. In the above-mentioned structure in which the holding member is provided, it may be also possible to connect an end of a chain with the holding member (more preferably, the rear end thereof).

Further, in a structure of the spring-close type alligator clip, a spring for closing the alligator clip can be mounted to the pair of jaw members directly (namely, without providing any member between the spring and the pair of jaw members). Moreover, in the case of providing the holding member, a spring for urging the pair of jaw members may be provided with the holding member being a fulcrum. In the case of providing a spring with the holding member being a fulcrum, the holding shaft rotatably holding the pair of jaw members can be used as a fulcrum of the spring, for example. A spring to be directly mounted to the pair of jaw members should be usually connected to the jaw members. The spring provided with the holding member being fulcrum is not necessarily connected to the jaw members as long as at least an end of the spring is in contact with the jaw member.

[Link Mechanism]

As described above, there is a case that a holding member, which is an attracting member per se, is provided inside the alligator clip other than a pair of jaw members forming the alligator clip. There is also another case that a holding member provided on its front end side with an attracting member, is provided inside the alligator clip. In these cases, preferable is a link mechanism in which connecting the holding member with the pair of jaw members by means of a linking arm allows the attracting member provided at the front end of the holding member to be operated so as to project from the opening when the alligator clip is opened.

In such a link mechanism, the holding member is to relatively move in a specific direction (a front-rear direction) with respect to the pair of jaw members in opening and closing of the alligator clip. Accordingly, the holding shaft of the jaw members should be arranged to be slidable in the front-rear direction with respect to the holding member in the case that the holding shaft passes through the holding member. As a structure capable of the slide, exemplified can be a structure in which the holding member is provided with a guide groove having a width in the front-rear direction thereof to provide the holding shaft of the jaw members through the guide groove so that the holding shaft can move along the guide groove, for example.

In a case of forming the link mechanism, the linking arm can be also used as a spring for closing the alligator clip. Arranging the linking arm to be also used as a spring for closing the alligator clip allows the number of components to be reduced and the structure to be simplified. In the above description, described has been a structure in which the holding shaft of the pair of jaw members is used as the fulcrum of a spring. In the case that the linking arm is also used as a spring for closing the alligator clip, however, it is difficult to use the holding shaft of the jaw members as the fulcrum of a spring. This is because there is a requirement on one hand that the rotational shaft of the linking arm should not be slidable with respect to the holding member while the holding shaft of the jaw members should be slidable with respect to the holding member on the other hand.

[Stability of Holding Member]

In the case of providing the above-mentioned holding member, the holding member forms the attracting member on the holder side per se or holds the attracting member on the holder side. Accordingly, an unstable spatial position of the holding member inside the holder (the alligator clip) is not preferable for the purpose of stably secure a guiding operation of the attracting member for guiding the holder and the holder receiver to the proper engagement positions.

As for a stable spatial position of the holding member, in the above-mentioned various kinds of modes for carrying out the invention, there is first a case that the holding shaft of the pair of jaw members is provided through the holding member, and thereby, gives a holding operation upon the holding member. There is a second case that the holding member is used as the fulcrum of the spring for closing the alligator clip, so that the holding operation is given upon the holding member by means of the spring. There is also a third case that forming the link mechanism causes the holding operation upon the holding member by means of the linking arm.

The holding shaft of the jaw members, the fulcrum of the spring for closing the alligator clip and the rotational shaft of the linking arm are in a relation capable of using together in a various kinds of combinations mentioned above. Accordingly, not all of the first to third holding operations are given upon the holding member. At lease two of the holding operations, however, are given usually. This allows a spatial position of the holding member to be stable owing to at least two-point holding.

In the case that the link mechanism is not formed while the holding shaft of the jaw members, which passes through the holding member, is used as the fulcrum of the spring for closing the alligator clip, the holding member is one-point held on the holding shaft. In this case, the stability of the spatial position of the holding member is suspected. For the stability of the spatial position of the holding member, however, certain effective countermeasures can be taken in design as in Embodiment 3 mentioned later, for example, when it is taken into consideration that the stability is required at a time point of opening the alligator clip (at a time point that a guiding operation of the attracting member is required).

Embodiments

Now, embodiments of the invention will be described on the basis of the drawings. In all of the following embodiments, used is the above-mentioned spring-close type nonintersecting alligator clip. It goes without saying that the scope of the invention is not limited by the following embodiments.

Embodiment 1

Structure of Embodiment 1

Figure 2:
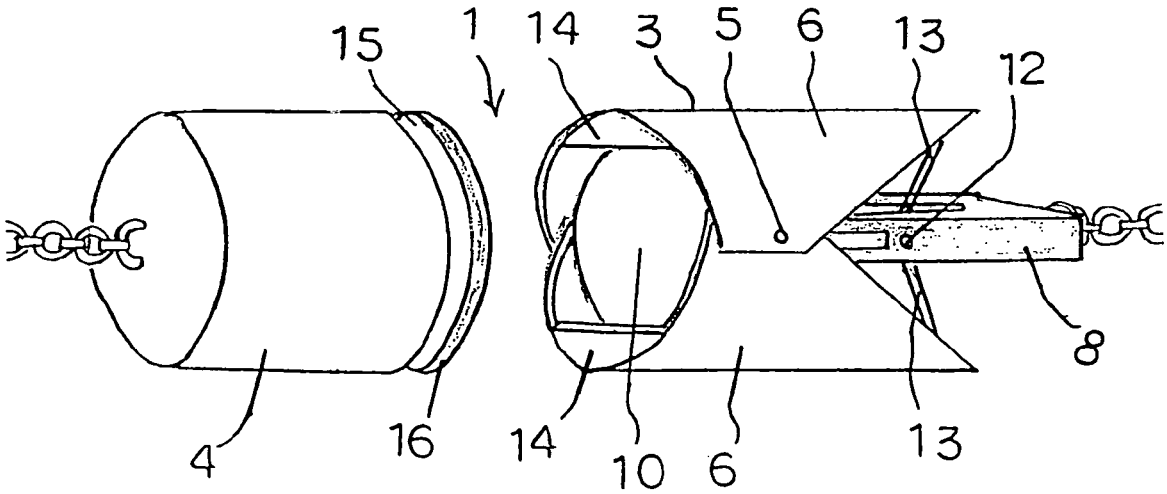
FIG. 2 is a perspective view in FIG. 1.

FIG. 1 is a front view of a clamping tool 1 for the chain ends of an accessory (a necklace) in accordance with Embodiment 1. FIG. 2 is a perspective view of the clamping tool. An alligator clip 3, which is a holder forming the clamping tool 1, and an interlocking member 4, which is a holder receiver, are formed on the respective ends of a chain portion 2 of the accessory.

Figure 3:
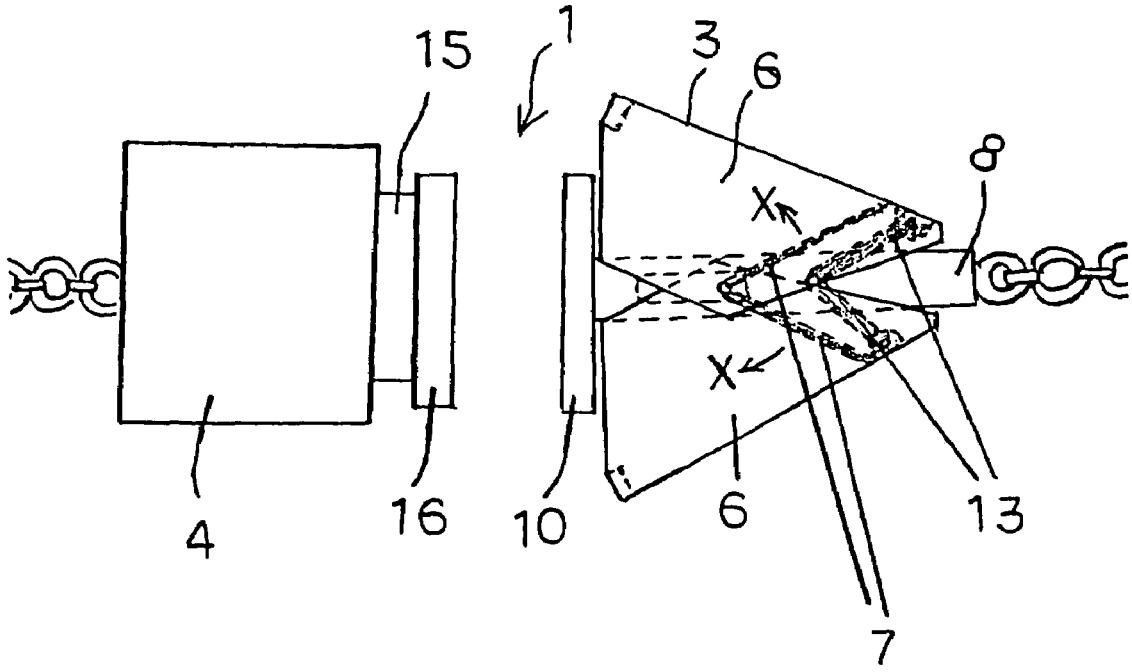
FIG. 3 illustrates an opening state of an alligator clip in accordance with Embodiment 1.

In the alligator clip 3, a holding shaft 5 rotatably holds a pair of jaw members 6 so that the pair of jaw members 6 would not intersect. The outer shape of the pair of jaw members 6 is close to a half cylinder as shown in FIG. 2. Accordingly, rotatably holding the pair of jaw members 6 on the same holding shaft 5 allows the alligator clip 3 to be in the shape of a substantial cylinder as a whole. The pair of jaw members 6 rotates about the holding shaft 5 so as to be able to perform opening and closing operations of a front end (the left end portion in the drawings) of the alligator clip 3. FIGS. 1 and 2 show the alligator clip 3 in a closing state. FIG. 3 shows the alligator clip 3 in an opening state.

The holding shaft 5 is provided with a spring 7, which is in the shape of a line in substantially one body with the pair of jaw members 6 and respective tips of which are in contact with the pair of jaw members 6, so that the spring 7 would be wound around the holding shaft 5. The spring 7 bears no load when the alligator clip 3 is in the closing state. In an operation of rotating the rear ends (a handle portion) of the pair of jaw members 6 in a closing direction to open the alligator clip 3 as shown in FIG. 3, the spring 7 resists by means of urging force in a direction shown by an arrow X in FIG. 3. Thus, the closing state shown in FIGS. 1 and 2 is a natural state of the clamping tool 1.

Figure 4:
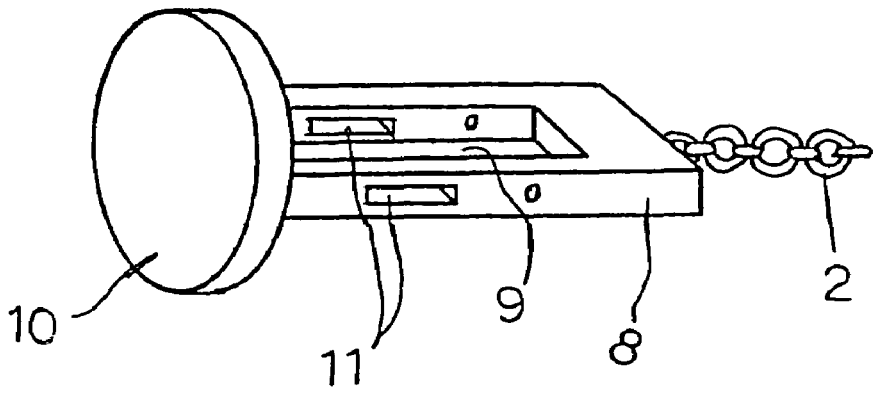
FIG. 4 is a perspective view of a holding member in accordance with Embodiment 1.

A holding member 8 is provided at the center part of the substantially cylinder-shaped alligator clip 3 formed from the pair of jaw members 6. The holding member 8 is a plate-shaped member provided at the center thereof with a notch 9 as shown in detail in FIG. 4. The rear end of the holding member 8 is connected with an end of the chain portion 2 of the accessory. On the front end of the holding member 8, fixed is a disk-shaped N-pole magnet 10. The N-pole magnet 10 is recessed a little to an inner side (a rear side) of the front end of the alligator clip 3 when the alligator clip 3 is in the closing state.

The holding member 8 is arranged to be mounted to the alligator clip 3 as described hereinafter. That is to say, the holding member 8 is first provided with a guide groove 11 through which the holding shaft 5 passes. The guide groove 11 has a constant width in a front-rear direction of the holding member 8. Accordingly, the holding shaft 5 can slide in the guide groove 11 in the front-rear direction. An arm shaft 12 is second provided in parallel to the holding shaft 5 so as to pass through a part of the holding member 8, the part being closer to the rear end than the guide groove 11. On the arm shaft 12, one end of each of a pair of linking arms 13 is rotatably held in the center notch of the holding member 8. The other end of each of the linking arms 13 is rotatably held at the rear end (a handle portion) of each of the pair of jaw members 6.

The holding member 8 is mounted to the alligator clip 3 in a state of two-point holding by means of the holding shaft 5, the arm shaft 12 and the linking arms 13, as described above. Accordingly, a relative relation of spatial positions between the holding member 8 and the alligator clip 3 does not irregularly vary or fluctuate except in an expected sliding operation in the front-rear direction even when the opening/closing operation of the alligator clip 3 is performed as described later.

In the opening state of the alligator clip 3 shown in FIGS. 1 and 2, an open angle of the pair of linking arms 13 about the arm shaft 12 defines a width of projection of the holding member 8 from the opening of the alligator clip 3. Therefore, the open angle of the pair of linking arms 13 is designed so that the width of the projection would be comparatively large. On the other hand, an open angle of the linear spring 7 about the holding shaft 5 is designed so as to be comparatively small for the purpose of preventing resistant to the opening operation of the alligator clip 3 from being excessive. Clamping portions 14 in the shape of an inward flange are respectively formed at positions on upper and lower ends shown in the drawings along the half-circular front ends of the pair of the jaw members 6.

In a part forming the opening of the alligator clip 3, the clamping portions 14 respectively projecting a little to an inner circumferential side of the circular opening are formed at the upper end of the upper jaw member 6 and at the lower end of the lower jaw member 6 in FIG. 1. On the other hand, the interlocking member 4 used as the holder receiver is in the shape of a column or a cylinder whose diameter is substantially same as that of the alligator clip 3. On the front end side (a side facing the alligator clip 3) of the interlocking member 4, fixed is an S-pole magnet 16 in the same shape as the N-pole magnet 10 through a neck portion 15 having a smaller diameter. As show in FIG. 5, the clamping portions 14 of the pair of jaw members 6 are caught on the neck portion 15 when the alligator clip 3 is closed to engage with the interlocking portion 4.

As for the N-pole magnet 10 and the S-pole magnet 16, it may be possible to provide the S-pole magnet on the holding member 8 side and the N-pole magnet on the interlocking member 4 side. Further, any one of the magnets may be formed from a metal material attracted by a magnet while the other is formed from a magnet.

Function of Embodiment 1

The clamping tool 1 for a necklace in Embodiment 1, which has the above-mentioned structure, is used as follows.

That is to say, in putting a necklace on, one hand grips the alligator clip 3 while the other hand grips the interlocking portion 4 so that the alligator clip 3 and the interlocking portion 4 would be placed behind the neck where the alligator clip 3 and the interlocking portion 4 are located roughly closely to each other.

At that time, using the hand gripping the alligator clip 3 to rotate the handle portions (the rear ends) of the pair of jaw members 6 in the closing direction allows the alligator clip 3 to be in the opening state shown in FIG. 3 against the urging force of the spring 7. At the same time, an operation of the linking arms 13 causes the holding member 8 to be pushed to the opening side of the alligator clip 3, so that the N-pole magnet 10 fixed at the front end of the holding member 8 projects from the opening of the alligator clip 3. Accordingly, the N-pole magnet 10 at the front end of the holding member 8 and the S-pole magnet 16 at the front end of the interlocking member 4 are attracted by each other, and thereby, connected to each other.

Figure 5:
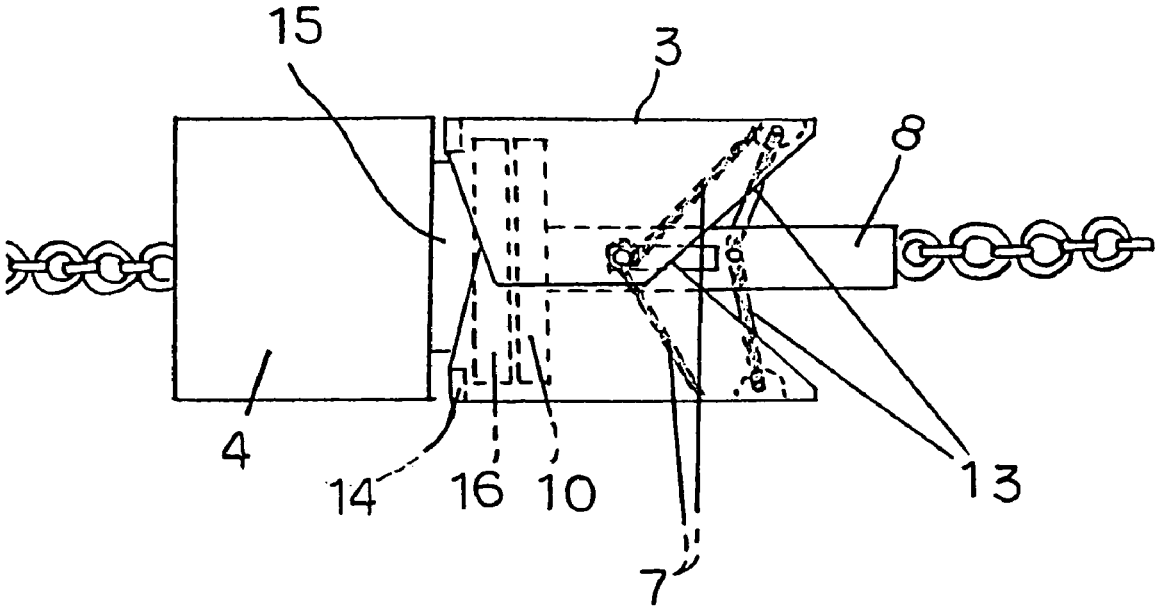
FIG. 5 is a front view of a clamped clamping tool in accordance with Embodiment 1.

Such a connecting operation allows the alligator clip 3 and the interlocking member 4 to be automatically guided to and located at the proper engagement positions shown in FIG. 5. Moreover, the N-pole magnet 10 and the S-pole magnet 16 are in the same shape of a disk, so that the above location is extremely accurate. It can be easily confirmed by a click of a signal sounded in attraction between the N-pole magnet 10 and the S-pole magnet 16 (a sound in a collision between the magnets) that the alligator clip 3 and the interlocking member 4 are located at the proper engagement positions.

The hand rotating the handle portions of the alligator clip 3 is released after confirming the signal sound. The alligator clip 3 then returns to the closing state due to the urging force of the spring 7 as shown in FIG. 5. At the same time, the front end portion of the interlocking member 4 is drawn into the inside of the alligator clip 3 together with the holding member 8. As a result, the clamping portions 14 of the pair of jaw members 6 engage with the neck portion 15 of the interlocking member 4. This allows the ends of the chain portion of a necklace to be simply and certainly interlocked without visual observation.

In putting the necklace off, the alligator clip 3 and the interlocking member 4 interlocking with each other are gripped by the respective hands, the hand gripping the alligator clip 3 is used to let the alligator clip 3 be in the opening state similarly to the above, and then, the alligator clip 3 and the interlocking member 4 can be separated from each other against the attractive force between the N-pole magnet 10 and the S-pole magnet 16. In other words, interlock of the clamping tool 1 cannot be released unless an operation of opening the alligator clip 3 against the urging force of the spring 7 is performed.

Embodiment 2

Figure 6:
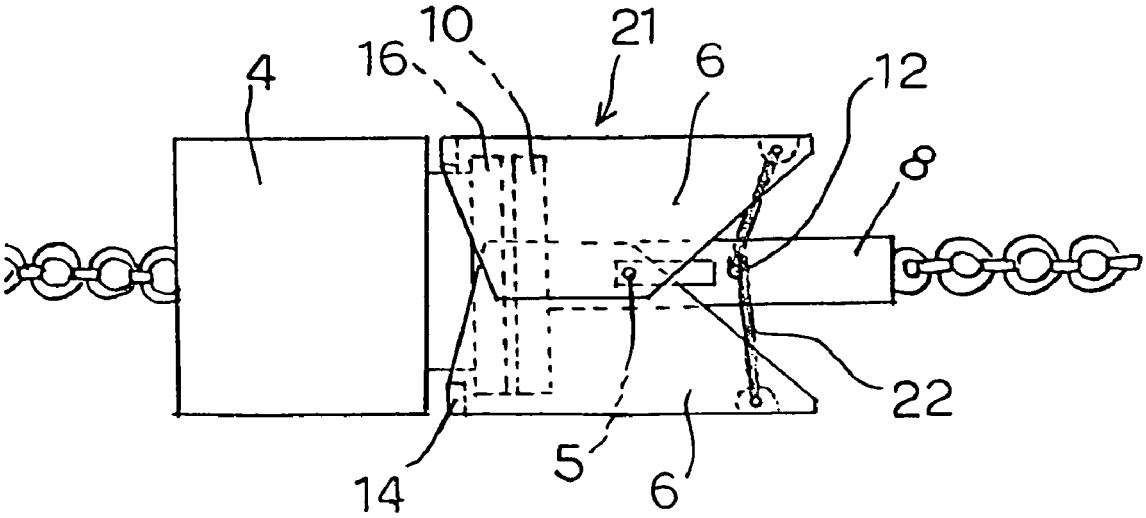
FIG. 6 is a front view of a clamped clamping tool in accordance with Embodiment 2.

FIG. 6 shows a clamping tool 21 for chain ends of an accessory in accordance with Embodiment 2. FIG. 6 shows a state that the alligator clip 3 and the interlocking member 4 of the clamping tool 21 interlock with each other.

In Embodiment 2, the holding shaft 5 rotatably holding the pair of jaw members 6 is not provided with a spring, which is provided in Embodiment 1. The arm shaft 12 is provided with a spring 22 whose tips are integrally and rotatably held on the pair of jaw members 6 instead of the linking arm. The spring 22 has urging force for maintaining the closing state of the alligator clip 3, similarly to the spring 7 in Embodiment 1. At the same time, the spring 22 forms a link mechanism similar to that of the linking arms 13 in Embodiment 1 since the tips of the spring 22 are rotatably held on the jaw members 6.

The open angle of the spring 22 is comparatively large similarly to the case of the pair of linking arms 13 in Embodiment 1. Accordingly, the holding member 8 (the N-pole magnet 10) projects much in the opening state of the alligator clip 3 although this is not shown in the drawings. Further, the number of components is reduced more than the case of Embodiment 1. The resistance of the spring 22 to an operation of rotating the handle portions of the pair of jaw members 6 in the closing direction, however, is larger a little since the open angle of the spring 22 is large.

The structure, operation and effect in Embodiment 2 are same as those in Embodiment 1 except the above point.

Embodiment 3

Figure 7:
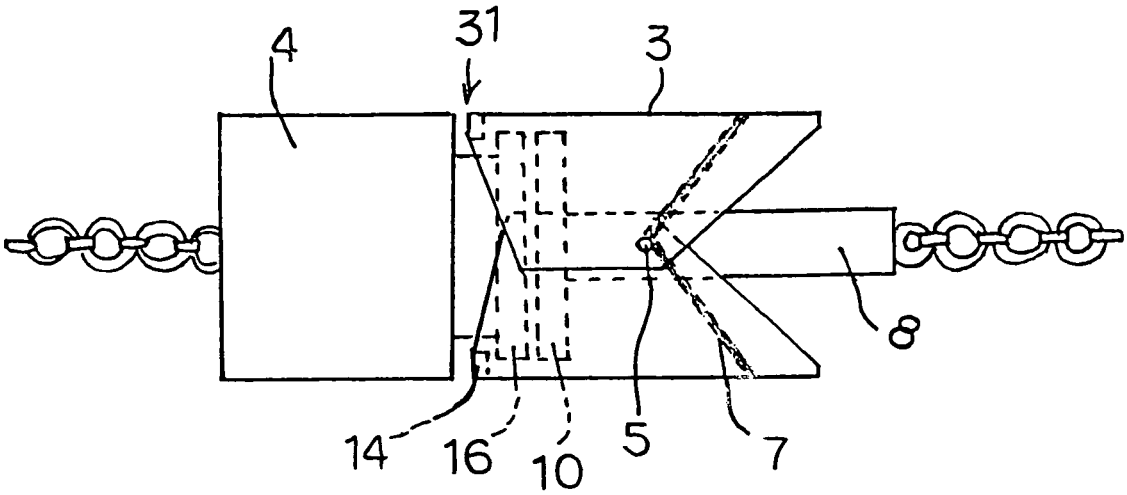
FIG. 7 is a front view of a clamped clamping tool in accordance with Embodiment 3.
Figure 8:
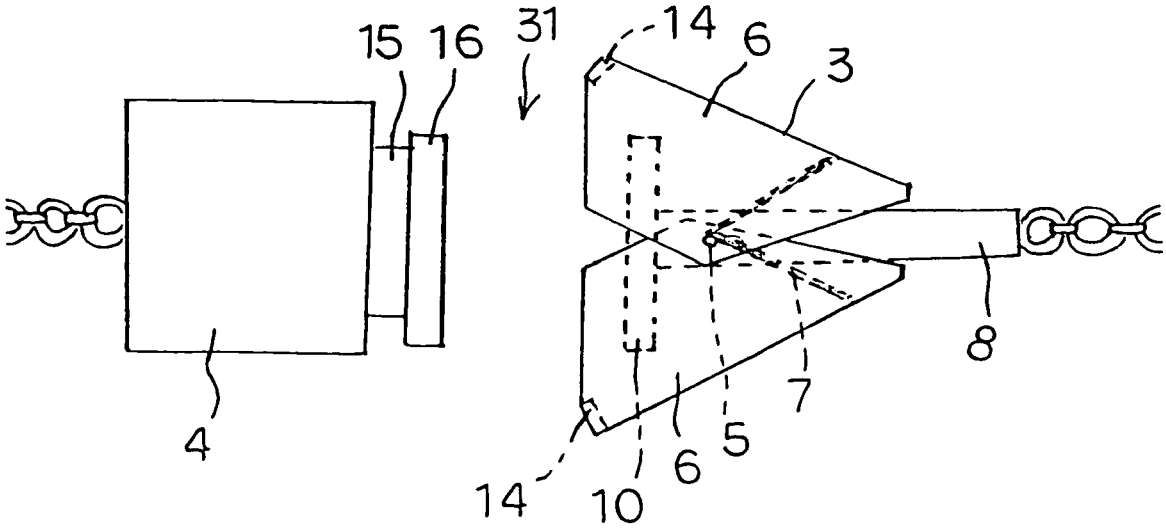
FIG. 8 illustrates an opening state of an alligator clip in accordance with Embodiment 3.

FIGS. 7 and 8 show a clamping tool 31 for chain ends of an accessory in accordance with Embodiment 3. FIG. 7 shows an interlocking state of the alligator clip 3 and the interlocking member 4 of the clamping tool 31. FIG. 8 shows the alligator clip 3 and the interlocking member 4, which separate from each other, and the alligator clip 3 in the opening state.

In Embodiment 3, the arm shaft 12 and the linking arms 13 in Embodiment 1 are not provided. A handle portion (a rear end) of the holding member 8 is formed longer instead of the above. As a result, in comparison with the case of Embodiment 1, there are following two points different in operation as shown in FIG. 8.

First, the N-pole magnet 10 fixed to the holding member 8 does not project from the opening of the alligator clip 3 in the opening state of the alligator clip 3. The certainty of a guiding operation of the N-pole magnet 10 and the S-pole magnet 16 when the interlocking member 4 is located roughly closely to the opening alligator clip 3, however, is as good as the case of Embodiment 1.

Second, the holding member 8 is structurally held at one point on the alligator clip 3 by means of the holding shaft 5. In the opening state of the alligator clip 3, however, the rear end of the holding member 8, which is formed relatively long, is held so as to be gripped between the handle portions (the rear ends) of the pair of jaw members 6. This allows substantial two-point holding to be achieved. Accordingly, when a guiding operation of the N-pole magnet 10 and the S-pole magnet 16 is required, the holding member 8 is not likely to irregularly vary or fluctuate to impede the guiding operation.

In Embodiment 3, the structure, operation and effect other than the above point are same as those in Embodiment 1.

Embodiment 4

Figure 9:
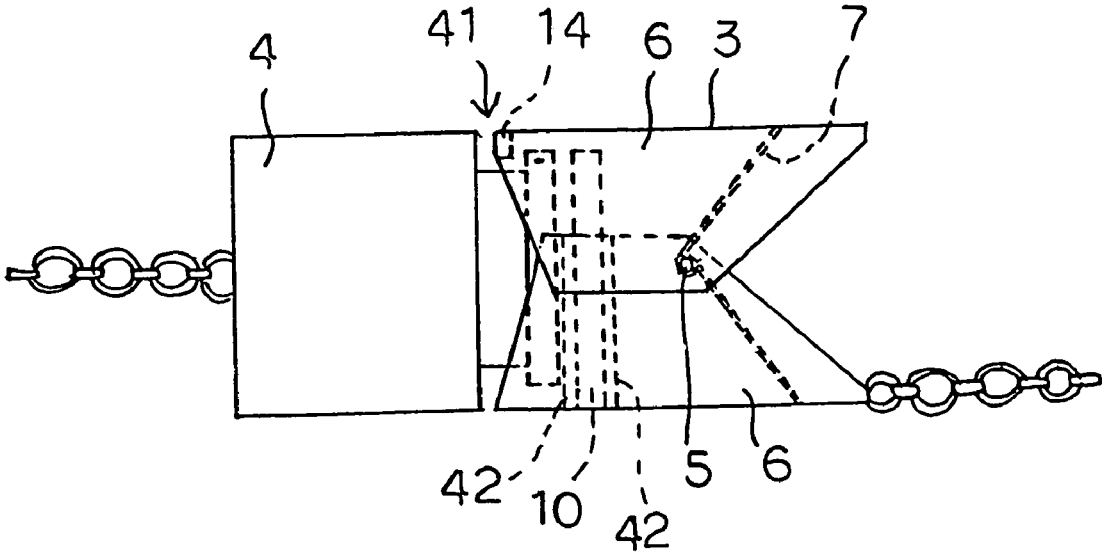
FIG. 9 is a front view of a clamped clamping tool in accordance with Embodiment 4.
Figure 10:
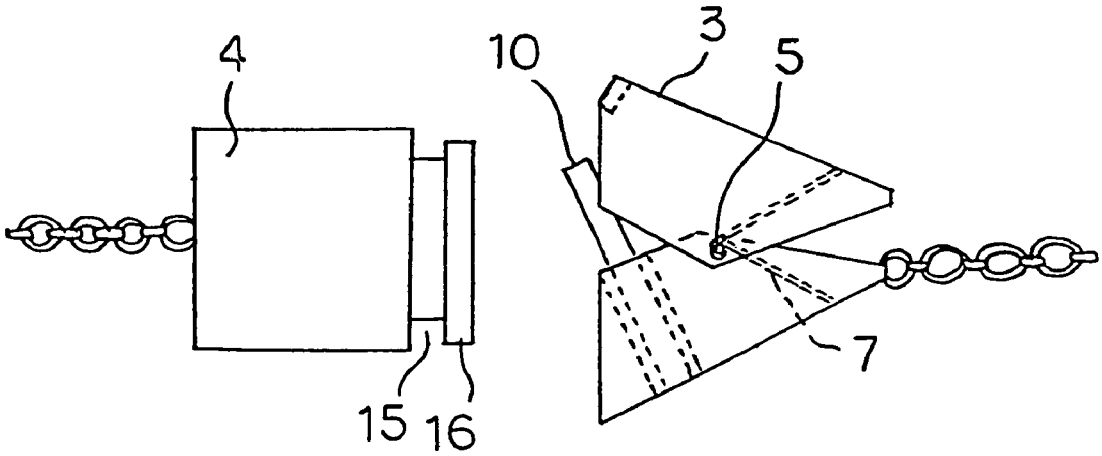
FIG. 10 illustrates an opening state of an alligator clip in accordance with Embodiment 4.
Figure 11:
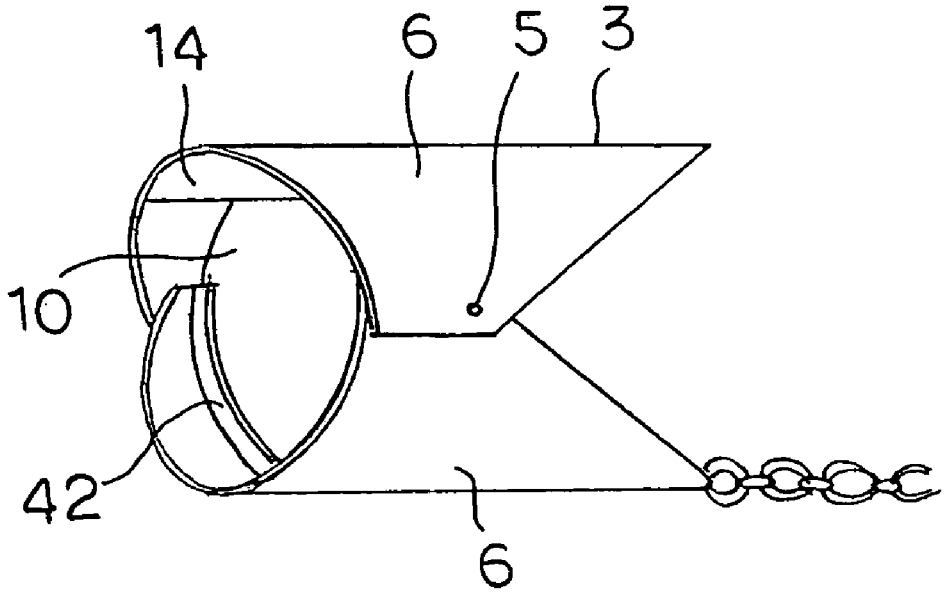
FIG. 11 is a perspective view of an alligator clip in accordance with Embodiment 4.

FIGS. 9 to 11 show a clamping tool 41 for chain ends of an accessory in accordance with Embodiment 4. FIG. 9 shows an interlocking state between the alligator clip 3 and the interlocking member 4 of the clamping tool 41. FIG. 10 shows a separating state of the alligator clip 3 and the interlocking member 4 as well as the alligator clip 3 in the opening state. FIG. 11 is a perspective view of the alligator clip 3 in the closing state.

In Embodiment 4, a structure of the interlocking member 4 is same as that of Embodiments 1 to 3, but a structure of the alligator clip 3 is different from any one of Embodiments 1 to 3. That is to say, in Embodiment 4, there is no link mechanism as in Embodiment 1 or Embodiment 2. Moreover, no holding member 8 as in Embodiments 1 to 3 exists. Accordingly, a structure of the clamping tool 41 can be greatly simplified in Embodiment 4.

In other words, in the alligator clip 3, the pair of jaw members 6 is rotatably held on the holding shaft 5 in nonintersecting arrangement. Furthermore, the holding shaft 5 is provided with a spring 7, which is in the shape of a line in substantially one body with the pair of jaw members 6 and respective tips of which are in contact with the pair of jaw members 6, so that the spring 7 would be wound around the holding shaft 5. Similarly to the case in Embodiment 1, the spring 7 bears no load when the alligator clip 3 is in the closing state (in FIG. 9). The spring 7, however, resists an operation of rotating the rear ends of the pair of jaw members 6 in a closing direction (refer to FIG. 10). Thus, the closing state shown in FIGS. 9 and 11 is a natural state of the clamping tool 41.

A disk-shaped N-pole magnet 10 is fixed on an inner side of one jaw member 6. A connecting part of the N-pole magnet 10 connected with the jaw member 6 is fixed by means of a pair of flanges 42 formed in parallel along the inner circumferential surface of the jaw member 6. A fixed location of the N-pole magnet 10 is recessed a little to an inner side (a rear end side) of the front end of the alligator clip 3 when the alligator clip 3 is in the closing state, as shown in FIG. 9.

Accordingly, the N-pole magnet 10 does not project from the opening of the alligator clip 3 in the opening state of the alligator clip 3. The certainty of a guiding operation of the N-pole magnet 10 and the S-pole magnet 16 when the interlocking member 4 is located roughly closely to the opening alligator clip 3, however, is as good as the case of Embodiment 1.

In Embodiment 4, the clamping portion 14 similar to that of Embodiment 1 is only provided in the jaw member 6 on which no N-pole magnet 10 is fixed among the pair of jaw members 6. Accordingly, the clamping portion of the jaw member 6 on which the N-pole magnet 10 is fixed is not likely to obstruct an attracting operation between the S-pole magnet 16 and the N-pole magnet 10 when the alligator clip 3 is closed to engage with the interlocking member 4 as shown in FIG. 9. Simultaneously, the clamping portion 14 provided in the jaw member 6 on which no N-pole magnet 10 is fixed is caught on the neck portion 15 of the interlocking member 4, so that engagement between the alligator clip 3 and the interlocking member 4 can be secured.

The structure, operation and effect in Embodiment 4 are same as those in Embodiment 1 except the above point.

What is claimed is:

1. A clamping tool for chain ends of an accessory to be interlocked with each other having a holder provided at one end of a chain portion of the accessory and a holder receiver engageable with the holder provided at the other end of the chain portion, the holder and the holder receiver interrockable with each other, wherein the holder and the holder receiver together comprising a pair of magnetically attracting members, both members having magnets attracting each other or one member having a magnet and the other member having a metal material attracted by the magnet, the magnets or the magnet and the metal material fixed at positions of guiding the holder and the holder receiver to a proper engaging location, and further wherein the holder is a spring-closing alligator clip having a pair of rotably-connected jaw members, each having handle portions at rear ends thereof, rotatable between closed and open positions, wherein the rotably connected jaw members are spring-biased to the closed position and rotateable to the open position by force applied to their handle portions so as to overcome the spring-biasing, and the holder receiver is an interlocking member positionable between the pair of jaw members of the holder and interlocked therewith when the pair of jaw members are in the closed position.

2. The clamping tool for chain ends of an accessory according to claim 1, wherein the accessory is a necklace, a bracelet or an anklet.

3. The clamping tool for chain ends of an accessory according to claim 1, wherein the chain portion is a member formed from a chain, a string, a belt, yarn or a comparatively small number of stick-shaped bodies unfixedly connected.

4. The clamping tool for chain ends of an accessory according to claim 3, wherein the chain portion is formed from metal, an inorganic material selected from silicic materials including at least precious stone, a vegetable material, or a resin material.

5. The clamping tool for chain ends of an accessory according to claim 1, wherein the holder and the holder receiver form a mechanism that engagement of the holder and the holder receiver enables interlock of the clamping tool to be achieved while releasing the engagement allows the clamping tool to be released.

6. The clamping tool for chain ends of an accessory according to claim 1, wherein the alligator clip is a nonintersecting alligator clip having the pair of jaw members rotatably held substantially in parallel.

7. The clamping tool for chain ends of an accessory according to claim 1, wherein one attracting member is provided in the alligator clip and the other attracting member is provided at a tip of the interlocking member.

8. The clamping tool for chain ends of an accessory according to claim 1, wherein an attracting member provided in the alligator clip is fixed to any one of the pair of jaw members or a holding member for holding the attracting member is held on a holding shaft for rotatably holding the pair of jaw members.

9. The clamping tool for chain ends of an accessory according to claim 1, wherein an attracting member provided in the alligator clip or a holding member for holding the attracting member is connected to the pair of jaw members by means of a linking arm to form a link mechanism in which the attracting member operates to project from an opening in opening the pair of jaw members.

10. A clamping tool for interlocking chain ends of an accessory having a chain portion that has two chain ends, the tool comprising:

at one chain end of the chain portion, a holder that is a spring-closing alligator clip comprised of two intersecting jaw members having handle portions and rotably connected at a holding shaft, the rotable jaw members being rotatable about the holding shaft between open and closed positions and spring-biased to the open position; and, at the other chain end, a holder receiver, positionable between the intersecting jaw members of the holder and interlocking with the holder when the intersecting jaw members of the holder are in the closed position, wherein the holder and the holder receiver, together, comprise a pair of magnetically attracting members wherein either, both of the pair of magnetically attracting members comprise magnetic material, or one member of the pair of magnetically attracting members comprises magnetic material and the other comprises material attracted by magnetic material.

11. A clamping tool for an accessory having a chain portion having two chain ends, the clamping tool comprising: a spring-closing alligator clip-type holder, the holder comprising two jaw members, rotatable between open and closed positions, rotably connected at a holding shaft to a holding member having front and rear portions; two linking arms, each arm pivotably fixed at one of its ends to the holding member at an arm shaft and, at the other of their ends, each linking arm contacting a different one of the jaw members, forming a linking mechanism, wherein the arm shaft is located between the holding shaft and the rear portion of the holding member; the holder further comprising, at the front portion of the holding member, an attracting member comprised of magnetic material; the clamping tool further comprising, at the other chain end, a holder receiver, at least a portion of which is comprised of magnetic material or material attracted by a magnet, the holder receiver positionable between the pair of jaw members of the holder and interlocking therewith when the jaw members are in the closed position, and wherein the linking arms of the linking mechanism operate in spring-like fashion to bias the jaw members in the closed position, and further wherein the attracting member on the holding member protrudes from the holder when the jaw members are rotated to the open position.

* * * * *